US008319803B2

(12) United States Patent
Woo et al.

(10) Patent No.: US 8,319,803 B2
(45) Date of Patent: Nov. 27, 2012

(54) DATA DRIVER AND LIQUID CRYSTAL DISPLAY DEVICE INCLUDING THE SAME

(75) Inventors: Jae Hyuck Woo, Osan-si (KR); Jae Goo Lee, Yongin-si (KR); Won Sik Kang, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 542 days.

(21) Appl. No.: 12/628,600

(22) Filed: Dec. 1, 2009

(65) Prior Publication Data

US 2010/0134514 A1 Jun. 3, 2010

(30) Foreign Application Priority Data

Dec. 1, 2008 (KR) ..... 10-2008-0120431

(51) Int. Cl.

| | |
|---|---|
| ***G09G 5/10*** | (2006.01) |
| ***G09G 5/00*** | (2006.01) |
| ***G09G 3/36*** | (2006.01) |
| ***G09G 5/02*** | (2006.01) |

(52) U.S. Cl. ..... 345/690; 345/204; 345/89; 345/98; 345/589

(58) Field of Classification Search ..... None
See application file for complete search history.

(56) References Cited

U.S. PATENT DOCUMENTS

| | | | | |
|---|---|---|---|---|
| 7,304,624 | B2 * | 12/2007 | Lee | 345/89 |
| 2007/0247409 | A1 * | 10/2007 | Nishimura et al. | 345/89 |
| 2008/0316234 | A1 * | 12/2008 | Toriumi | 345/690 |

FOREIGN PATENT DOCUMENTS

| | | |
|---|---|---|
| JP | 2004-354625 | 12/2004 |
| JP | 2006-163290 | 6/2006 |
| KR | 1020030005748 | 1/2003 |
| KR | 1020070021360 | 2/2007 |

OTHER PUBLICATIONS

English Abstract for Publication No. 1020030005748.
English Abstract for Publication No. 2004-354625.
English Abstract for Publication No. 2006-163290.
English Abstract for Publication No. 1020070021360.

* cited by examiner

*Primary Examiner* — Andrew L Sniezek
(74) *Attorney, Agent, or Firm* — F. Chau & Associates, LLC

(57) ABSTRACT

A data driver for driving a liquid crystal display (LCD) device includes a common grayscale voltage generator configured to output a plurality of common grayscale voltages, a data processing unit configured to expand externally input image data to provide expanded image data and to adjust an offset of the expanded image data to output data offset adjusted image data, and a data signal output unit configured to output as data signals a first grayscale voltage corresponding to the expanded image data and a second grayscale voltage corresponding to the data offset adjusted image data among the plurality of common grayscale voltages.

15 Claims, 5 Drawing Sheets

FIG. 2

| GRAY LEVEL OF IMAGE DATA | GRAY LEVEL OF FIRST DATA | IMAGE DATA | FIRST DATA |
|---|---|---|---|
| 0 | 0 | 00000000 | 000000000 |
| 1 | 2 | 00000001 | 000000010 |
| 2 | 4 | 00000010 | 000000100 |
| 253 | 506 | 11111101 | 111111010 |
| 254 | 508 | 11111110 | 111111100 |
| 255 | 510 | 11111111 | 111111110 |

DATA DRIVER AND LIQUID CRYSTAL DISPLAY DEVICE INCLUDING THE SAME

CROSS-REFERENCE TO RELATED APPLICATION

This application claims the benefit, under 35 U.S.C. §119, of Korean Patent Application No. 10-2008-0120431, filed on Dec. 1, 2008, in the Korean Intellectual Property Office, which is incorporated by reference herein in its entirety.

BACKGROUND

1. Technical Field

The present invention relates to a display device, and more particularly, to a data driver and a liquid crystal display (LCD) device including the same.

2. Description of Related Art

LCDs are a type of widely used flat panel display. A LCD device includes two display panels each having field-generating electrodes, such as pixel electrodes and a common electrode, and a liquid crystal layer interposed therebetween. The liquid crystal display generates an electric field through a liquid crystal layer by applying a voltage to field generating electrodes, determines the alignment of liquid crystal molecules in the liquid crystal layer therethrough, and controls the polarization of incident light, thereby displaying an image.

The LCD device is thinner and lighter than other types of display devices. It also has relatively low power consumption and low driving voltage. The LCD device receives image data from an external source, selects one grayscale voltage from among a plurality of grayscale voltages corresponding to the image data, and provides the selected grayscale voltage to a liquid crystal panel, thereby displaying an image.

Image data of 24 bits, e.g., 8-bit red (R), green (G), and blue (B) image data, may be input to an LCD device for mobile devices. In a conventional LCD device for mobile devices, a data driver may use separate gamma to select one grayscale voltage from among 256 grayscale voltages corresponding to each of the 8-bit R, G, and B image data and provide the selected grayscale voltage to a liquid crystal panel. However, the data driver using the separate gamma is physically large and therefore, the overall size of the LCD device including the data driver is increased to accommodate the data driver. For example, when the separate gamma is used, a decoder corresponding to each of the R, G, and B image data is needed to transmit 256 grayscale voltages corresponding to each of the R, G, and B image data to the liquid crystal panel through the data driver. The decoders occupy a large portion of the overall area of the data driver. Accordingly, the overall area of the LCD device is increased.

In addition, a conventional data driver needs R, G and B grayscale voltage blocks corresponding to the R, G, and B image data, respectively, which increases the power consumption of the LCD device.

SUMMARY

According to some embodiments of the present invention, a data driver includes a common grayscale voltage generator configured to output a plurality of common grayscale voltages, a data processing unit configured to expand externally input image data to provide expanded image data and to increase or decrease the expanded image data to output data offset adjusted image data, and a data signal output unit configured to output data signals including a grayscale voltage corresponding to the expanded image data and a grayscale voltage corresponding to the data offset adjusted image data among the plurality of common grayscale voltages According to other embodiments of the present invention, an LCD device includes a liquid crystal panel configured to display an image and a driving unit including the data driver connected with the liquid crystal panel to drive the liquid crystal panel.

According to some embodiments of the present invention, a method for driving a liquid crystal display (LCD) device includes generating a plurality of common grayscale voltages, receiving image data from an external source expanding the image data to provide expanded image data, adjusting a data offset of the expanded image data to output data offset adjusted image data, and outputting to the LCD device data signals including a first grayscale voltage corresponding to the expanded image data and a second grayscale voltage corresponding to the data offset adjusted image data among the plurality of common grayscale voltages.

BRIEF DESCRIPTION OF THE DRAWINGS

The present invention will become more apparent by describing in detail exemplary embodiments thereof with reference to the attached drawings in which:

FIG. 2 is a table illustrating the operation of a data expander illustrated in FIG. 1;

DETAILED DESCRIPTION OF EXEMPLARY EMBODIMENTS

Figure 1:
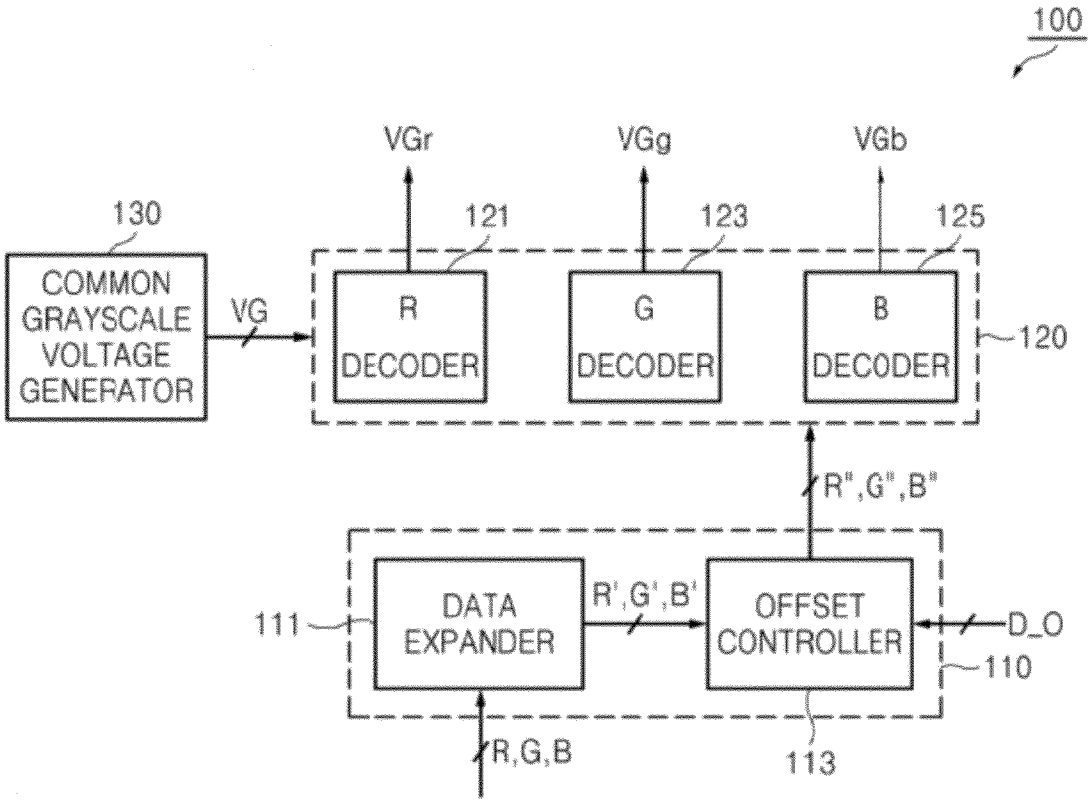
FIG. 1 is a schematic block diagram of a data driver according to some embodiments of the present invention.

The present invention now will be described more fully hereinafter with reference to the accompanying drawings, in which embodiments of the invention are shown. This invention may, however, be embodied in many different forms and should not be construed as limited to embodiments set forth herein. Rather, embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

Figure 3:
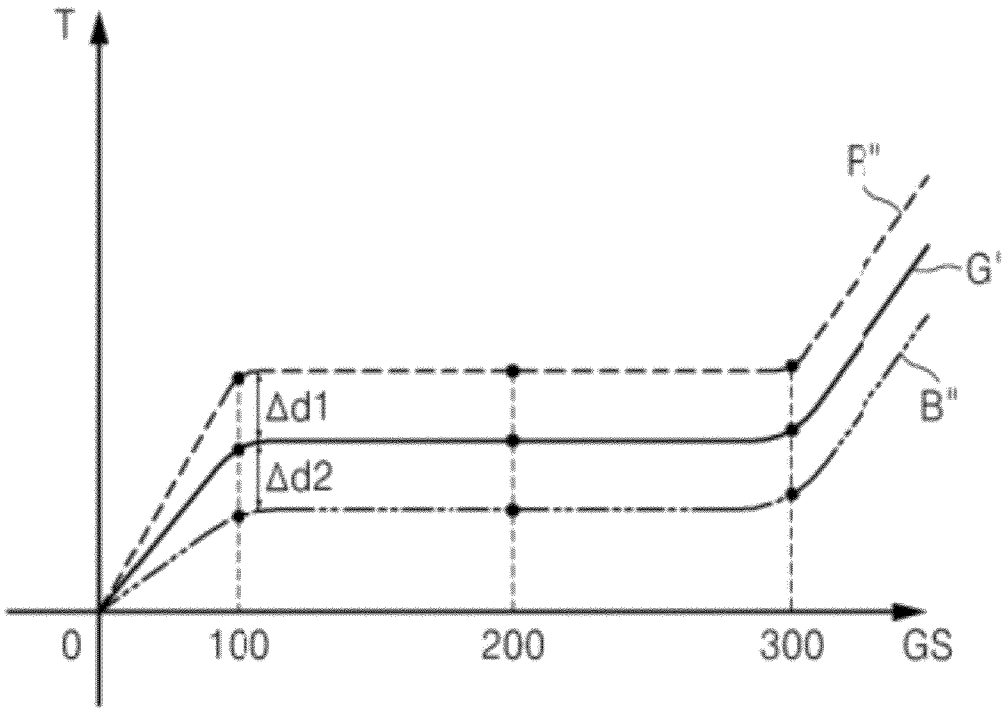
FIGS. 3 and 4 are graphs illustrating the operation of an offset controller illustrated in FIG. 1.
Figure 4:
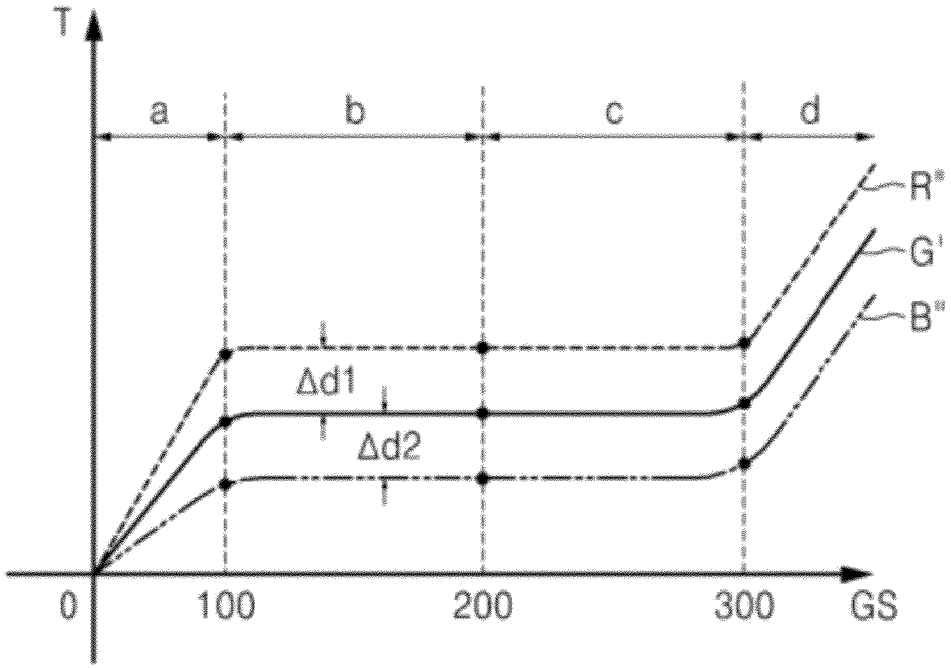

FIG. 1 is a schematic block diagram of a data driver 100 according to some embodiments of the present invention. FIG. 2 is a table illustrating the operation of a data expander 111 of FIG. 1. FIGS. 3 and 4 are graphs illustrating the operation of an offset controller 113 of FIG. 1.

Referring to FIGS. 1 and 2, the data driver 100 includes a common grayscale voltage generator 130, a data processing unit 110, and a data signal output unit 120.

The common grayscale voltage generator 130 outputs a plurality of grayscale voltages VG. For example, the common grayscale voltage generator 130 may output 512 grayscale voltages respectively indicating gray level 0 through gray level 511. A grayscale voltage VG of gray level 0 may have a lower transmittance or a darker gray level than a grayscale voltage VG of gray level 511.

Since the 512 grayscale voltages VG are output from the common grayscale voltage generator 130, 512 grayscale voltage transmission lines (not shown) may be formed between the common grayscale voltage generator 130 and the data signal output unit 120. The grayscale voltages VG output from the common grayscale voltage generator 130 may be used as reference grayscale voltages VG for one portion of the image data, e.g., expanded G image data G', among a plurality of portions of the image data, e.g., expanded red (R) image data R', expanded green (G) image data G', and expanded blue (B) image data B', output from the data processing unit 110, but the present invention is not restricted thereto.

The data processing unit 110 may output expanded image data, e.g., the expanded R image data R', the expanded G image data G', and the expanded B image data B', with respect to a plurality of portions of the image data, e.g., image data R, image data G, and image data B, received from an external source. Alternatively, the data processing unit 110 may increase or decrease the expanded R, G, and B image data R', G', and B' and output data offset adjusted image data R", G", and B".

The data processing unit 110 includes the data expander 111 and the offset controller 113. The data expander 111 receives the image data R, the image data G, and the image data B from the external source and outputs the expanded R, G, and B image data R', G', and B'. Each of the R, G, and B image data input to the data expander 111 may be N bits in length, where N is a natural number. The data expander 111 may perform expansion of the image data R, G, and B according to I-bit expansion data where I is a natural number and output the expanded R, G, and B image data R', G', and B'. For example, the data expander 111 may increase the number bits in each of the image data R, G, and B by I bits.

As an example, when 8-bit R image data of "00000001" is input to the data expander 111, the data expander 111 may append 1-bit expansion data of "0" to the least significant bit (LSB) of the 8-bit R image data of "00000001" and output 9-bit expanded R image data R' of "000000010". At this time, the data expander 111 may multiply R image data by M, where M is any natural number except 1, and output expanded R image data R'. For example, the data expander 111 may output the two-times multiplied 9-bit expanded R image data R' of "000000010" by appending the 1-bit expansion data of "0" to the LSB of the 8-bit R image data of "00000001". In the same manner, the data expander 111 may output the expanded G and B image data G' and B'.

Since the expanded R, G, and B image data R', G', and B' are obtained by multiplying the 8-bit R, G, and B image data by 2, the gray level of each expanded image data R', G', or B' is two times higher than the gray level of each 8-bit image data R, G, or B. For example, when the 8-bit R image data of "00000001" input to the data expander 111 has gray level 1, the expanded R image data R' of "000000010" may have gray level 2 that is two times higher than gray level 1. At this time, the 8-bit R image data may be in the grayscale range from level 0 to level 255 and the expanded R image data R' may be in the grayscale range from level 0 to level 510.

The offset controller 113 of the data processing unit 110 adjusts a data offset of each of the expanded R, G, and B image data R', G', and B' output from the data expander 111 and outputs the data offset adjusted image data R", G", and B". The offset controller 113 may adjust the data offset of each of the expanded image data R', G', and B' output from the data expander 111 using an externally input offset data D_O of J bits, where J is any natural number except 1. For example, the offset controller 113 may add the J-bit offset data D_O to each of the expanded image data R', G', and B' and output the data offset adjusted image data R", G", and B", whose magnitude is larger than that of the expanded image data R', G', and B' by the magnitude of the J-bit offset data D_O. In another example, the offset controller 113 may subtract the J-bit offset data D_O from each of the expanded image data R', G', and B' and output the data offset adjusted image data R", G", and B", whose magnitude is less than that of the expanded image data R', G', and B' by the magnitude of the J-bit offset data D_O.

As an example, when 4-bit offset data D_O of "1010" is input to the offset controller 113 and each of the expanded image data R', G', and B' from the data expander 111 has a value of "000000010", the offset controller 113 may add the remaining bits "010" of the offset data D_O except the most significant bit (MSB) to the expanded image data R', G', and B' of "000000010", thereby outputting data offset adjusted image data R", G", and B" of "000000100". At this time, the MSB "1" of the offset data D_O may be a sign bit, for example, for increasing the expanded image data R', G', and B'. The remaining bits "010" of the offset data D_O except the sign bit may be offset adjusting bits for adjust the data offset of the expanded image data R', G', and B'.

As another example, when 4-bit offset data D_O of "0010" is input to the offset controller 113 and each of the expanded image data R', G', and B' from the data expander 111 has a value of "000000010", the offset controller 113 may subtract the remaining bits "010" of the offset data D_O except the MSB from the expanded image data R', G', and B' of "000000010", thereby outputting data offset adjusted image data R", G", and B" of "000000000". Here, the MSB "0" of the offset data D_O may be a sign bit, for example, for decreasing the expanded image data R', G', and B'. The remaining bits "010" of the offset data D_O except the sign bit may be offset adjusting bits for adjust the data offset of the expanded image data R', G', and B'.

Referring to FIGS. 1, 3, and 4, the offset controller 113 may perform data offset adjustment with respect to each expanded image data R', G', or B', which corresponds to each of the plurality of grayscale voltages VG output from the common grayscale voltage generator 130, as illustrated in FIG. 3, or the offset controller 113 may divide the grayscale voltages VG into a predetermined number of sections, e.g., 4 sections "a", "b", "c", and "d", and perform data offset adjustment with respect to each expanded image data R', G', or B' corresponding to each section "a", "b", "c", or "d" using the same offset data D_O.

Referring to FIGS. 1 and 3, the offset controller 113 performs data offset adjustment with respect to the expanded R image data R' and the expanded B image data B', which are output from the data expander 111. The expanded G image data G' output from the data expander 111 is used as reference data for adjusting the offset of the expanded R and B image data R' and B'.

For example, each of the expanded R, G, and B image data R', G', and B' output from the data expander 111 may have a value of "001100100" corresponding to gray level 100 among the grayscale voltages VG output from the common grayscale voltage generator 130 and first offset data D_O of "1010" and second offset data D_O of "0011" may be input to the offset controller 113. At this time, the offset controller 113 adds the remaining bits of the first offset data D_O except the MSB to the expanded R image data R' of "001100100" on the basis of the expanded G image data G' of "001100100" and outputs the data offset adjusted R image data R" of "001100110". The magnitude of the data offset adjusted R image data R" is larger than that of the expanded G image data G' by a first offset level $\Delta d1$. In addition, the offset controller 113 subtracts the remaining bits of the second offset data D_O except the MSB from the expanded B image data B' of "001100100" on the basis of the expanded G image data G' of "001100100"

and outputs the data offset adjusted B image data B" of "001100001". The magnitude of the data offset adjusted B image data B" is less than that of the expanded G image data G' by a second offset level Δd2.

In the above-described embodiments, the offset controller 113 performs data offset adjustment with respect to the expanded R image data R' and the expanded B image data B', which correspond to each of the grayscale voltages VG output from the common grayscale voltage generator 130, using different offset data input from an outside, thereby performing reliable data offset adjustment with respect to each of the expanded image data R', G', and B', for example, setting each of the expanded image data R', G', and B' to a wanted voltage.

FIG. 3 also illustrates data offset adjustment with respect to the expanded R image data R' and the expanded B image data B' which correspond to gray level 200 and gray level 300 among the grayscale voltages VG output from the common grayscale voltage generator 130. This data offset adjustment with respect to gray level 200 and gray level 300 is the same as the data offset adjustment with respect to gray level 100, which has been described above. Thus, detailed descriptions thereof will be omitted.

According to some embodiments of the present invention, the offset controller 113 performs data offset adjustment with respect to the expanded R image data R' and the expanded B image data B' on the basis of the expanded G image data G', but the present invention is not restricted thereto. For example, the offset controller 113 may use the expanded R image data R' or the expanded B image data B' as reference data and perform data offset adjustment with respect to the rest image data G' and B' or R' and G'.

Referring to FIGS. 1 and 4, the offset controller 113 divides the grayscale voltages VG output from the common grayscale voltage generator 130 into the four sections "a", "b", "c", and "d" and performs data offset adjustment with respect to the expanded R image data R' and the expanded B image data B', which correspond to each of the sections "a", "b", "c", and "d", using the same offset data. At this time, the expanded G image data G' output from the data expander 111 may be reference data for adjusting the offset of the expanded R image data R' and the expanded B image data B'. For example, the offset controller 113 may divides the grayscale voltages VG into the section "a" ranging from gray level 0 to gray level 100, the section "b" ranging from gray level 101 to gray level 200, the section "c" ranging from gray level 201 to gray level 300, and the section "d" ranging from gray level 301 and up.

As an example, data offset adjustment of the expanded R image data R' and the expanded B image data B', which correspond to the section "b" ranging from gray level 101 to gray level 200 will be described.

Each of the expanded R, G, and B image data R', G', and B' output from the data expander 111 may have a value of "010010110" corresponding to gray level 150 in the section "b" among the four sections "a", "b", "c", and "d" and first offset data D_O of "1010" and second offset data D_O of "0010" may be input to the offset controller 113 as data offset adjusting values for the section "b". The offset controller 113 adds the remaining bits of the first offset data D_O except the MSB to the expanded R image data R' of "010010110" on the basis of the expanded G image data G' of "010010110" and outputs the data offset adjusted R image data R" of "010011000".

The magnitude of the data offset adjusted R image data R" is larger than that of the expanded G image data G' by a first offset level Δd1. In addition, the offset controller 113 subtracts the remaining bits of the second offset data D_O except the MSB from the expanded B image data B' of "010010110" on the basis of the expanded G image data G' of "010010110" and outputs the data offset adjusted B image data B" of "010010100". The magnitude of the data offset adjusted B image data B" is less than that of the expanded G image data G' by a second offset level Δd2.

According to some embodiments of the present invention, the offset controller 113 regularly adjusts a data offset with respect to each of the sections "a", "b", "c", and "d" using the same offset data D_O, i.e., a pair of the first offset data D_O and the second offset data D_O which have the same offset adjusting bits but have different sign bits, thereby reducing the number of registers (e.g., flip-flops) needed for the data offset adjustment of the expanded image data R', G', and B' and reducing unnecessary offset adjustment.

The data offset adjustment of the expanded R and B image data R' and B' corresponding to gray level in the section "b" has been described. Data offset adjustment of the expanded R and B image data R' and B' corresponding to gray level in each of the other sections "a", "c", and "d" can be performed in the same manner as described above. Thus, detailed description thereof will be omitted.

According to some embodiments of the present invention, the offset controller 113 performs data offset adjustment with respect to the expanded R image data R' and the expanded B image data B' on the basis of the expanded G image data G', but the present invention is not restricted to thereto. For example, the offset controller 113 may use the expanded R image data R' or the expanded B image data B' as reference data and perform data offset adjustment with respect to the rest image data G' and B' or R' and G'.

Referring to FIG. 1, the data signal output unit 120 of the data driver 100 receives the expanded image data R', G', and B' or the data offset adjusted image data R", G", and B" from the data processing unit 110 and outputs a grayscale voltage corresponding to each of the received data, i.e., the expanded image data R', G', and B' or the data offset adjusted image data R", G", and B" among the plurality of grayscale voltages VG output from the common grayscale voltage generator 130. In detail, the data processing unit 110 may output the expanded G image data G'. The data signal output unit 120 may select one grayscale voltage VGg corresponding to the expanded G image data G' output from the data processing unit 110 from among the grayscale voltages VG output from the common grayscale voltage generator 130 and output the selected grayscale voltage VGg as a data signal.

The data processing unit 110 may also output the data offset adjusted R image data R" and the data offset adjusted B image data B" on the basis of the expanded G image data G'. The data signal output unit 120 may select grayscale voltages VGr and VGb respectively corresponding to the data offset adjusted R image data R" and the data offset adjusted B image data B" from among the grayscale voltages VG output from the common grayscale voltage generator 130 and output the grayscale voltages VGr and VGb as data signals.

The data signal output unit 120 includes a plurality of decoders 121, 123, and 125. Of the plurality of decoders 121, 123, and 125, the second decoder 123 receives the expanded G image data G' and outputs as a data signal the grayscale voltage VGg corresponding to the expanded G image data G' among the grayscale voltages VG. The first decoder 121 and the third decoder 125 receive the data offset adjusted R image data R" and the data offset adjusted B image data B", respectively, and output as data signals the grayscale voltages VGr and VGb respectively corresponding to the data offset adjusted R image data R" and the data offset adjusted B image data B" among the grayscale voltages VG.

Figure 5:
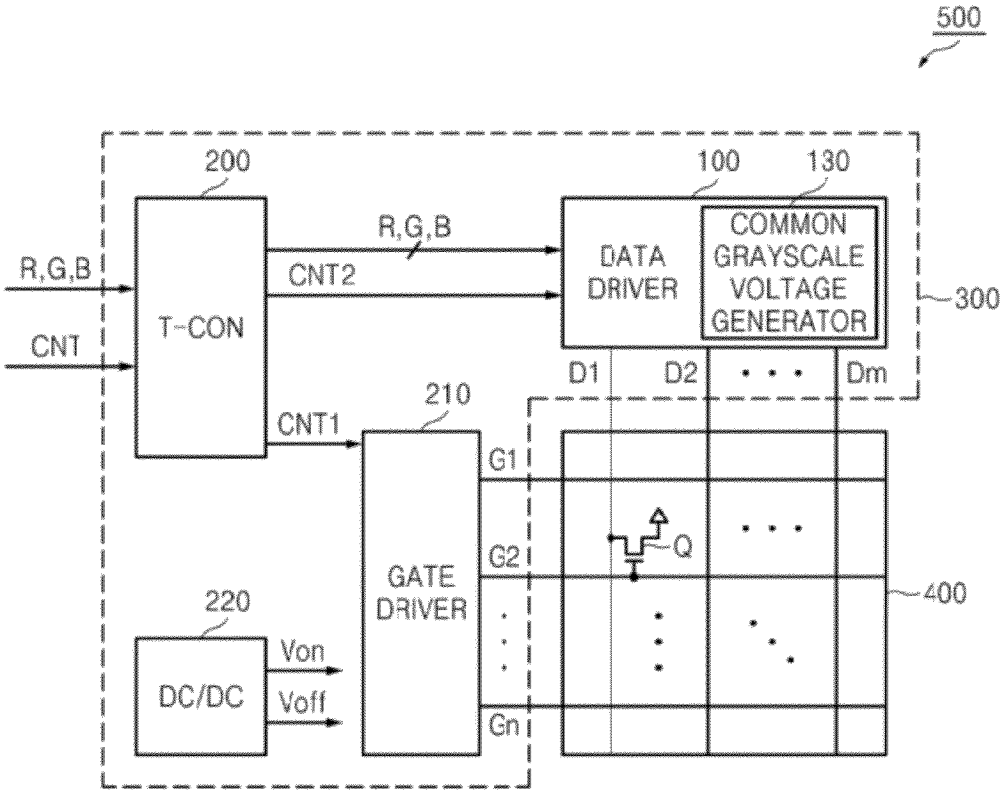
FIG. 5 is a schematic block diagram of a liquid crystal display (LCD) device according to some embodiments of the present invention.

FIG. 5 is a schematic block diagram of a liquid crystal display (LCD) device 500 according to some embodiments of the present invention. Referring to FIG. 5, the LCD device 500 includes a liquid crystal panel 400 and a driving unit 300 connected with the liquid crystal panel 400.

The liquid crystal panel 400 includes a plurality of display signal lines G1, G2, . . . , Gn, D1, D2, . . . , and Dm crossing one another and a switching element Q connected to two crossing lines at each of the intersections among the display signal lines G1 through Gn and D1 through Dm. Although not shown, the liquid crystal panel 400 may also include a red, green or blue color filter for the switching element Q so that a unit pixel formed by the switching element Q can display a color image. The liquid crystal panel 400 may be formed by bonding two display substrates with a liquid crystal material interposed therebetween.

The driving unit 300 includes a timing controller (T-CON) 200, a direct current-to-direct current (DC-DC) converter 220, a gate driver 210, and the data driver 100. The timing controller 200 outputs controls signals, e.g., a first control signal CNT1 and a second control signal CNT2, for controlling the gate driver 210 and the data driver 100 in response to an externally input control signal CNT. The timing controller 200 also outputs externally input image data R, G, and B to the data driver 100.

The DC-DC converter 220 generates a plurality of driving voltages, e.g., a gate-on voltage Von and a gate-off voltage Voff. The gate-on voltage Von and the gate-off voltage Voff are provided to the gate driver 210 to drive the switching element Q of the liquid crystal panel 400. The gate driver 210 is connected with some of the display signal lines, e.g., a plurality of gate lines G1 through Gn and provides the gate-on voltage Von or the gate-off voltage Voff to each of the gate lines G1 through Gn.

The data driver 100 is connected with others of the display signal lines, e.g., a plurality of data lines D1 through Dm. The data driver selects a grayscale voltage corresponding to each of the image data R, G, and B received from the timing controller 200 from among a plurality of grayscale voltages generated by the common grayscale voltage generator 130 and provides the selected grayscale voltage to the liquid crystal panel 400 as a data signal. The data driver 100 is substantially the same as the data driver 100 described with reference to FIGS. 1 through 4. Thus, a detailed description thereof will be omitted.

Although the common grayscale voltage generator 130 is included in the data driver 100 in some embodiments of the present invention, the present invention is not restricted thereto. For example, the common grayscale voltage generator 130 may be separately provided outside the data driver 100. In addition, the elements, e.g., the timing controller 200, the DC-DC converter 220, the gate driver 210, and the data driver 100, of the driving unit 300 may be formed on a single chip or may be separately formed on different chips.

According to some embodiments of the present invention, instead of a plurality of grayscale voltage generators conventionally needed for R, G, and B image data, respectively, a single common grayscale voltage generator is used and grayscale voltages are selected with respect to each of expanded R, G, and B image data and data offset adjusted R, G, and B image data in a data driver, and therefore, the size of the data driver can be reduced. In addition, since only single common grayscale voltage generator is used, the power consumption of an LCD device including the data driver can be reduced.

While the present invention has been particularly shown and described with reference to exemplary embodiments thereof, it will be understood by those of ordinary skill in the art that various changes in forms and details may be made therein without departing from the spirit and scope of the present invention as defined by the following claims.

What is claimed is:

1. A data driver comprising:

a common grayscale voltage generator configured to output a plurality of common grayscale voltages;

a data processing unit configured to expand image data to provide expanded image data and to adjust a data offset of the expanded image data to output data offset adjusted image data; and a data signal output unit configured to output data signals including a first grayscale voltage corresponding to the expanded image data and a second grayscale voltage corresponding to the data offset adjusted image data among the plurality of common grayscale voltages.

2. The data driver of claim 1, wherein the data processing unit comprises:

a data expander configured to expand the image data of N bits using I-bit expansion data and output the expanded image data where N and I are natural numbers; and an offset controller configured to receive J-bit offset data and to add the J-bit offset data to the expanded image data to output the data offset adjusted image data with an increased data offset or to subtract the J-bit offset data from the expanded image data to output the data offset adjusted image data with a decreased data offset where J is any natural number except 1.

3. The data driver of claim 2, wherein the data expander expands the N-bit image data by a factor of M according to the I-bit expansion data and outputs the expanded image data where M is any natural number except 1.

4. The data driver of claim 2, wherein one bit of the J-bit offset data is a sign bit for increasing or decreasing the expanded image data and remaining bits of the J-bit offset data are offset adjusting bits for adjusting a number of bits of the expanded image data according to the sign bit.

5. The data driver of claim 1, wherein the data processing unit increases or decreases the expanded image data corresponding to each of the plurality of common grayscale voltages and output the data offset adjusted image data.

6. The data driver of claim 1, wherein the data processing unit divides the plurality of common grayscale voltages into a plurality of sections, adjusts the data offset of the expanded image data corresponding to each of the plurality of sections by the same amount, and output the data offset adjusted image data.

7. The data driver of claim 1, wherein the data signal output unit comprises a plurality of decoders, one of the decoders outputs the grayscale voltage corresponding to the expanded image data among the plurality of common grayscale voltages as one of the data signals and each of the rest decoders outputs the grayscale voltage corresponding to the data offset adjusted image data among the plurality of common grayscale voltages as another of the data signals.

8. A liquid crystal display device comprising:

a liquid crystal panel configured to display an image; and a driving unit comprising a data driver connected with the liquid crystal panel to drive the liquid crystal panel, the data driver comprising a common grayscale voltage generator configured to output a plurality of common grayscale voltages, a data processing unit configured to expand image data to provide expanded image data and to adjust a data offset of the expanded image data to output data offset adjusted image data, and a data signal output unit configured to output data signals including a first grayscale voltage corresponding to the expanded image data and a second grayscale voltage corresponding to the data offset adjusted image data among the plurality of common grayscale voltages.

9. The liquid crystal display device of claim 8, wherein the data processing unit comprises:

a data expander configured to expand the image data of N bits using I-bit expansion data and output the expanded image data where N and I are natural numbers; and an offset controller configured to receive J-bit offset data and to add the J-bit offset data to the expanded image data to output the data offset adjusted image data with an increased data offset or to subtract the J-bit offset data from the expanded image data to output the data offset adjusted image data with a decreased data offset where J is any natural number except 1.

10. A method for driving a liquid crystal display (LCD) device comprising:

generating a plurality of common grayscale voltages;

receiving image data from an external source;

expanding the image data to provide expanded image data;

adjusting a data offset of the expanded image data to output data offset adjusted image data; and outputting to the LCD device data signals including a first grayscale voltage corresponding to the expanded image data and a second grayscale voltage corresponding to the data offset adjusted image data among the plurality of common grayscale voltages.

11. The method of claim 10, wherein the image data is expanded according to I-bit expansion data.

12. The method of claim 11, wherein the image data is expanded by a factor of M according to the I-bit expansion data and outputs the expanded image data where M is any natural number except 1.

13. The method of claim 10, wherein the data offset is determined from a J-bit offset data to one of, add the J-bit offset data to the expanded image data to output the data offset adjusted image data with an increased data offset and subtract the J-bit offset data from the expanded image data to output data offset adjusted image data with a decreased data offset where J is any natural number except 1.

14. The method of claim 13, wherein a number of bits of the expanded image data is adjusted according to the J-bit offset data comprising a sign bit for increasing or decreasing and remaining bits for adjusting a number of bits of the expanded image data according to the sign bit.

15. The method of claim 10, wherein the plurality of common grayscale voltages are divided into a plurality of sections, wherein the data offset of the expanded image data is adjusted corresponding to each of the plurality of sections by the same amount.

* * * * *